US011320104B1

(12) United States Patent
Perkins

(10) Patent No.: US 11,320,104 B1
(45) Date of Patent: May 3, 2022

(54) SOLAR-POWERED LIGHT FOR MOTORISTS ON ROADWAYS

(71) Applicant: Kendall Perkins, Santa Ana, CA (US)

(72) Inventor: Kendall Perkins, Santa Ana, CA (US)

( * ) Notice: Subject to any disclaimer, the term of this patent is extended or adjusted under 35 U.S.C. 154(b) by 0 days.

(21) Appl. No.: 17/307,018

(22) Filed: May 4, 2021

Related U.S. Application Data

(60) Provisional application No. 63/058,413, filed on Jul. 29, 2020.

(51) Int. Cl.

| | |
|---|---|
| ***F21S 9/03*** | (2006.01) |
| ***F21V 15/01*** | (2006.01) |
| ***F21V 3/02*** | (2006.01) |
| ***F21V 23/04*** | (2006.01) |
| ***F21V 31/00*** | (2006.01) |
| ***F21S 8/00*** | (2006.01) |
| ***F21V 29/54*** | (2015.01) |
| ***F21S 9/04*** | (2006.01) |
| ***F21Y 115/10*** | (2016.01) |
| ***F21W 131/103*** | (2006.01) |

(52) U.S. Cl.
CPC ..... *F21S 9/037* (2013.01); *F21S 8/032* (2013.01); *F21S 9/04* (2013.01); *F21V 3/02* (2013.01); *F21V 15/01* (2013.01); *F21V 23/0464* (2013.01); *F21V 29/54* (2015.01); *F21V 31/005* (2013.01); *F21W 2131/103* (2013.01); *F21Y 2115/10* (2016.08)

(58) Field of Classification Search
CPC ... F21S 8/032; F21S 9/037; F21S 9/04; F21V 23/0464; F21W 2131/103
See application file for complete search history.

(56) References Cited

U.S. PATENT DOCUMENTS

| | | | | |
|---|---|---|---|---|
| 5,839,816 | A * | 11/1998 | Varga | E01F 9/559 362/153.1 |
| 6,602,021 | B1 * | 8/2003 | Kim | E01F 9/559 116/63 R |
| 7,688,222 | B2 * | 3/2010 | Peddie | G08G 1/096783 340/905 |
| 8,231,240 | B1 * | 7/2012 | Rubio | F21S 9/04 362/192 |
| 8,899,776 | B2 * | 12/2014 | Oostdyk | F21S 8/032 362/153.1 |
| 9,702,098 | B1 * | 7/2017 | King | G08G 1/0116 |
| 2018/0305876 | A1 * | 10/2018 | Langford | G08G 1/166 |
| 2020/0258384 | A1 * | 8/2020 | Suh | H05B 45/20 |
| 2021/0383683 | A1 * | 12/2021 | Camras | F21V 23/04 |

* cited by examiner

*Primary Examiner* — William N Harris
(74) *Attorney, Agent, or Firm* — Kyle A. Fletcher, Esq.

(57) ABSTRACT

The solar-powered light for motorists on roadways is an electrical device. The solar-powered light for motorists on roadways is configured for use on a path of a multipath structure. This disclosure assumes that the path is a road. The solar-powered light for motorists on roadways mounts in the road. The solar-powered light for motorists on roadways generates electromagnetic radiation that illuminates the road when the road is in a period of darkness. The solar-powered light for motorists on roadways comprises a housing and a lamp circuit. The housing contains the lamp circuit. The lamp circuit is independently powered. By independently powered is meant that the lamp circuit can operate without an electrical connection to an external power source.

14 Claims, 8 Drawing Sheets

SOLAR-POWERED LIGHT FOR MOTORISTS ON ROADWAYS

CROSS REFERENCES TO RELATED APPLICATIONS

This non-provisional patent application claims priority to provisional patent application 63/058,413 that was filed on Jul. 29, 2020 by the applicant Kendall Perkins.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lighting systems specially adapted for transportation. (F21L)

SUMMARY OF INVENTION

The solar-powered light for motorists on roadways is an electrical device. The solar-powered light for motorists on roadways is configured for use on a path of a multipath structure. This disclosure assumes that the path is a road. The solar-powered light for motorists on roadways mounts in the road. The solar-powered light for motorists on roadways generates electromagnetic radiation that illuminates the road when the road is in a period of darkness. The solar-powered light for motorists on roadways comprises a housing and a lamp circuit. The housing contains the lamp circuit. The lamp circuit is independently powered. By independently powered is meant that the lamp circuit can operate without an electrical connection to an external power source.

These together with additional objects, features and advantages of the solar-powered light for motorists on roadways will be readily apparent to those of ordinary skill in the art upon reading the following detailed description of the presently preferred, but nonetheless illustrative, embodiments when taken in conjunction with the accompanying drawings.

In this respect, before explaining the current embodiments of the solar-powered light for motorists on roadways in detail, it is to be understood that the solar-powered light for motorists on roadways is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the solar-powered light for motorists on roadways.

It is therefore important that the claims be regarded as including such equivalent construction insofar as they do not depart from the spirit and scope of the solar-powered light for motorists on roadways. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
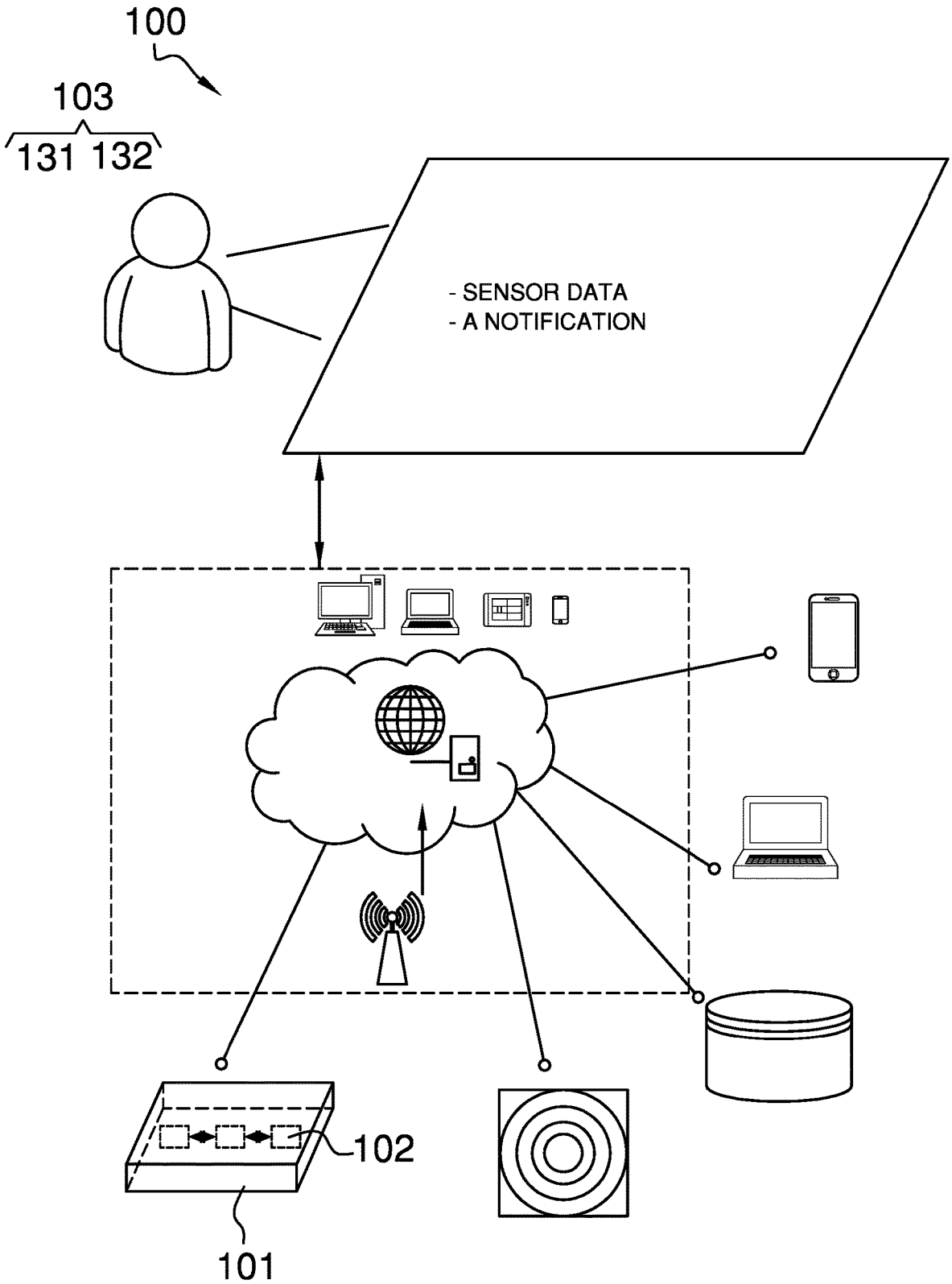
FIG. 1 is a block diagram an embodiment of the disclosure.
Figure 2:
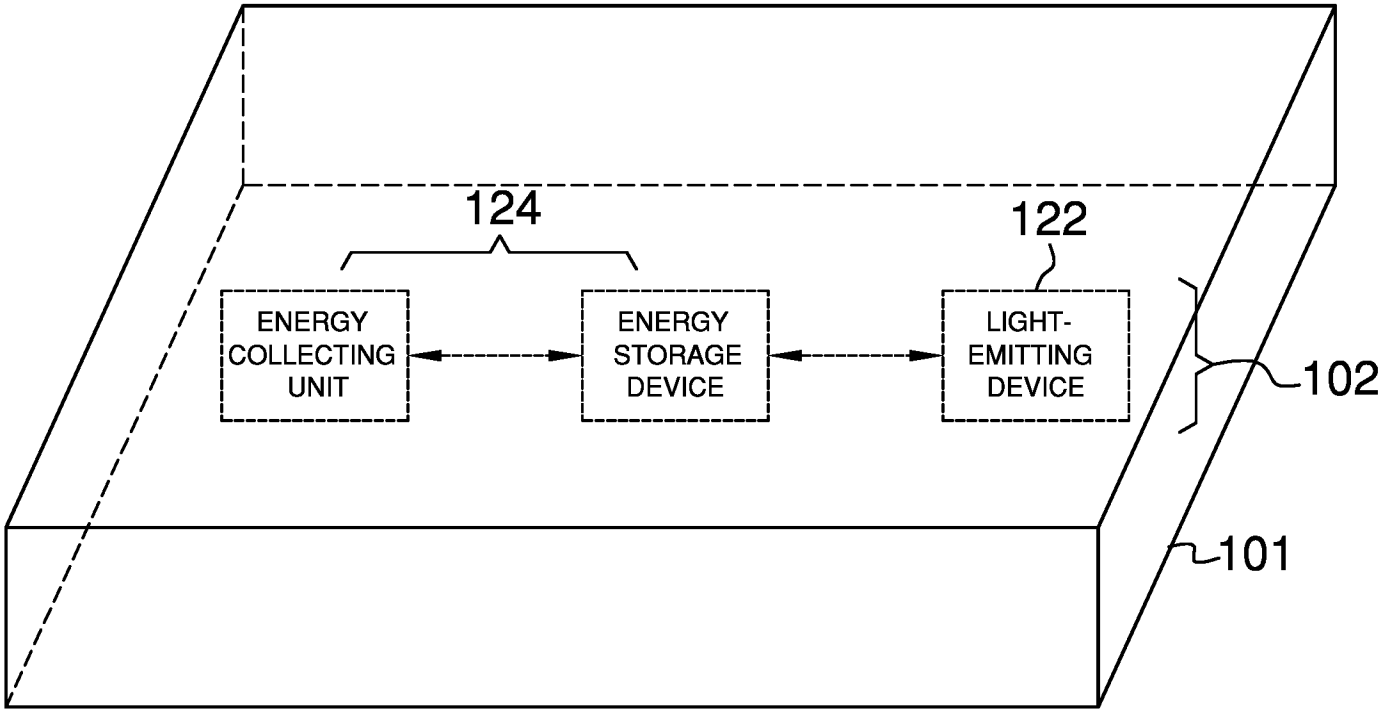
FIG. 2 is a block diagram of an embodiment of the disclosure.
Figure 3:
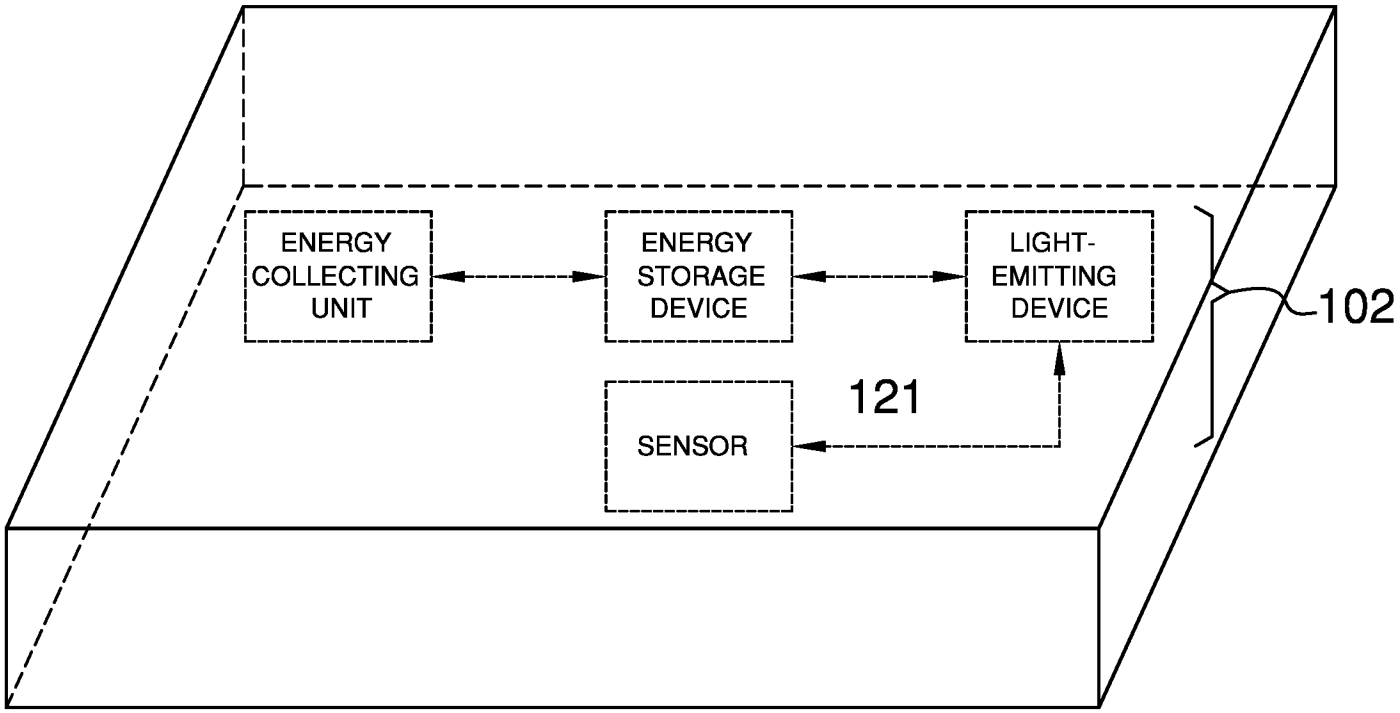
FIG. 3 is a block diagram of an embodiment of the disclosure.
Figure 4:
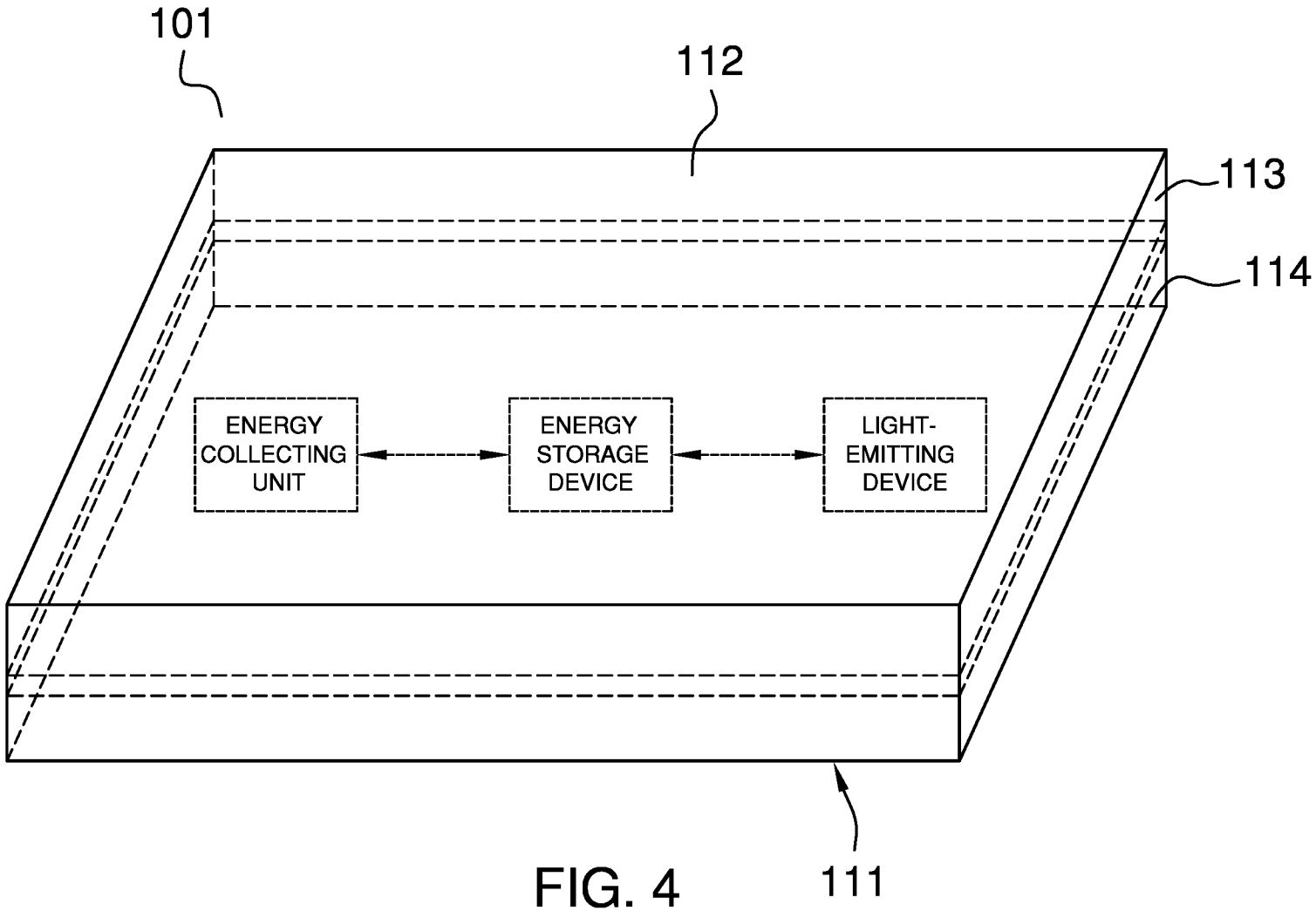
FIG. 4 is a block diagram of an alternate embodiment of the disclosure.
Figure 5:
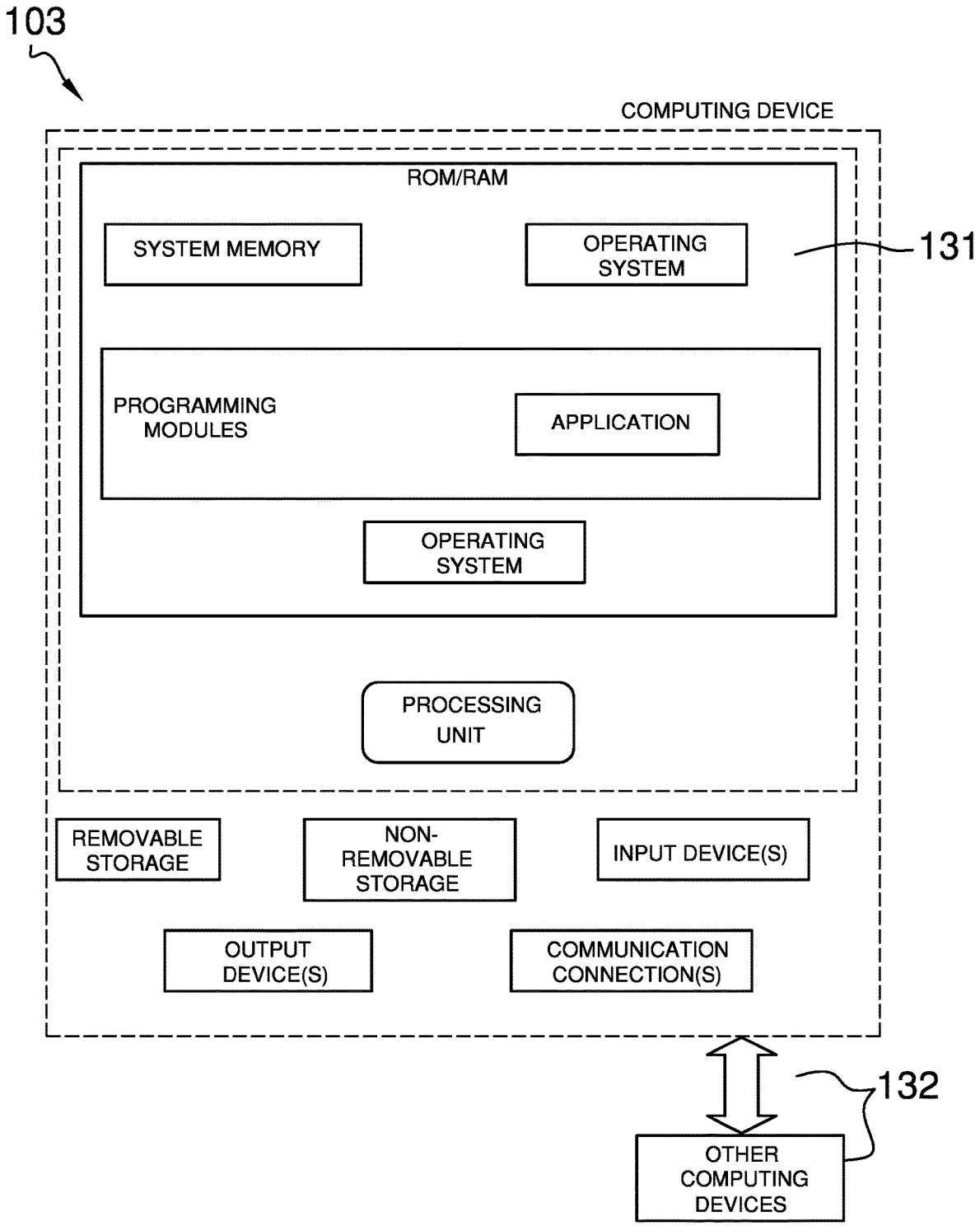
FIG. 5 is a block diagram of an alternate embodiment of the disclosure.
Figure 6:
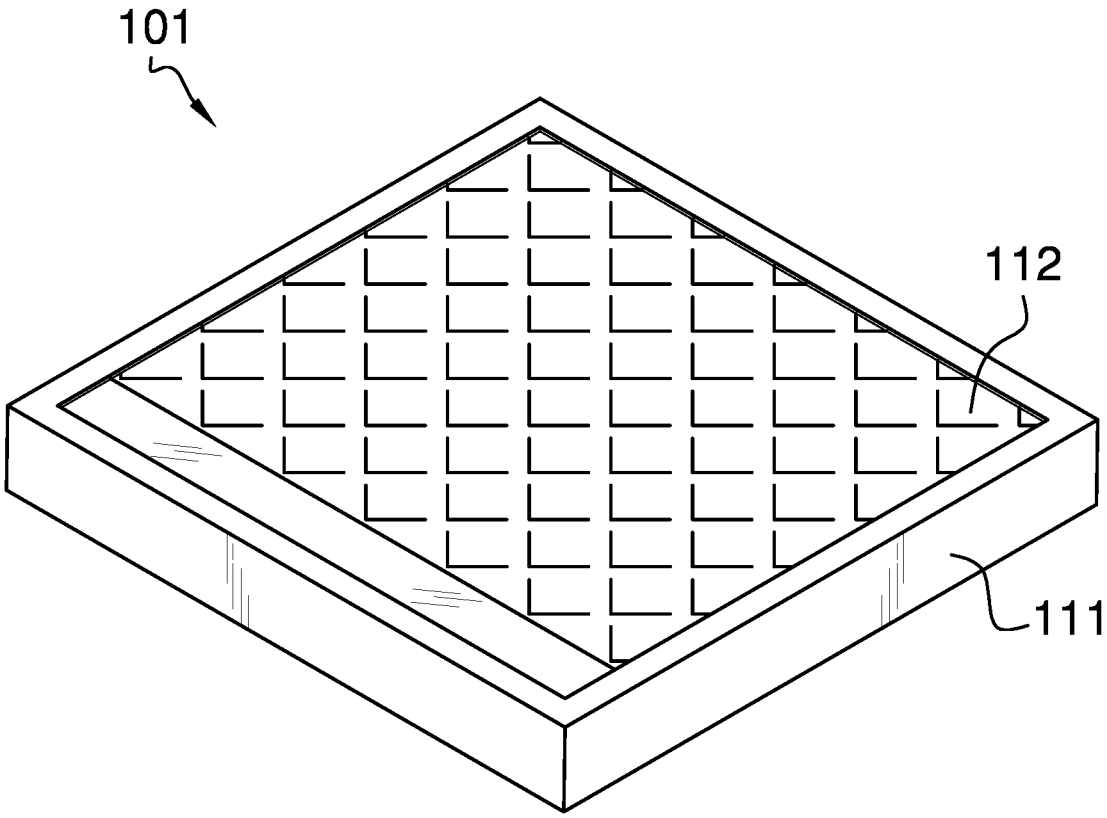
FIG. 6 is a perspective view of an embodiment of the disclosure.
Figure 7:
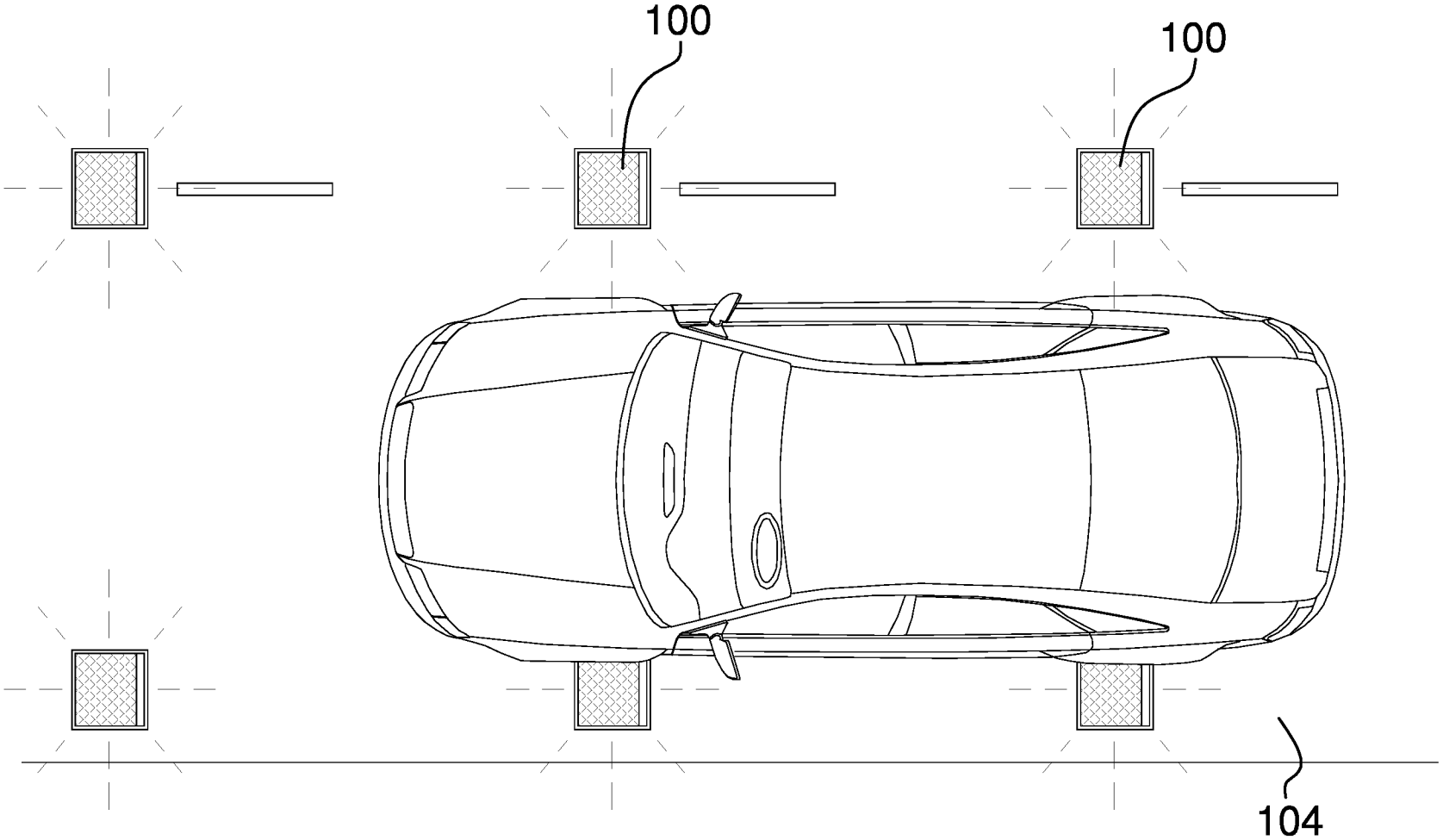
FIG. 7 is an in-use view of an embodiment of the disclosure.
Figure 8:
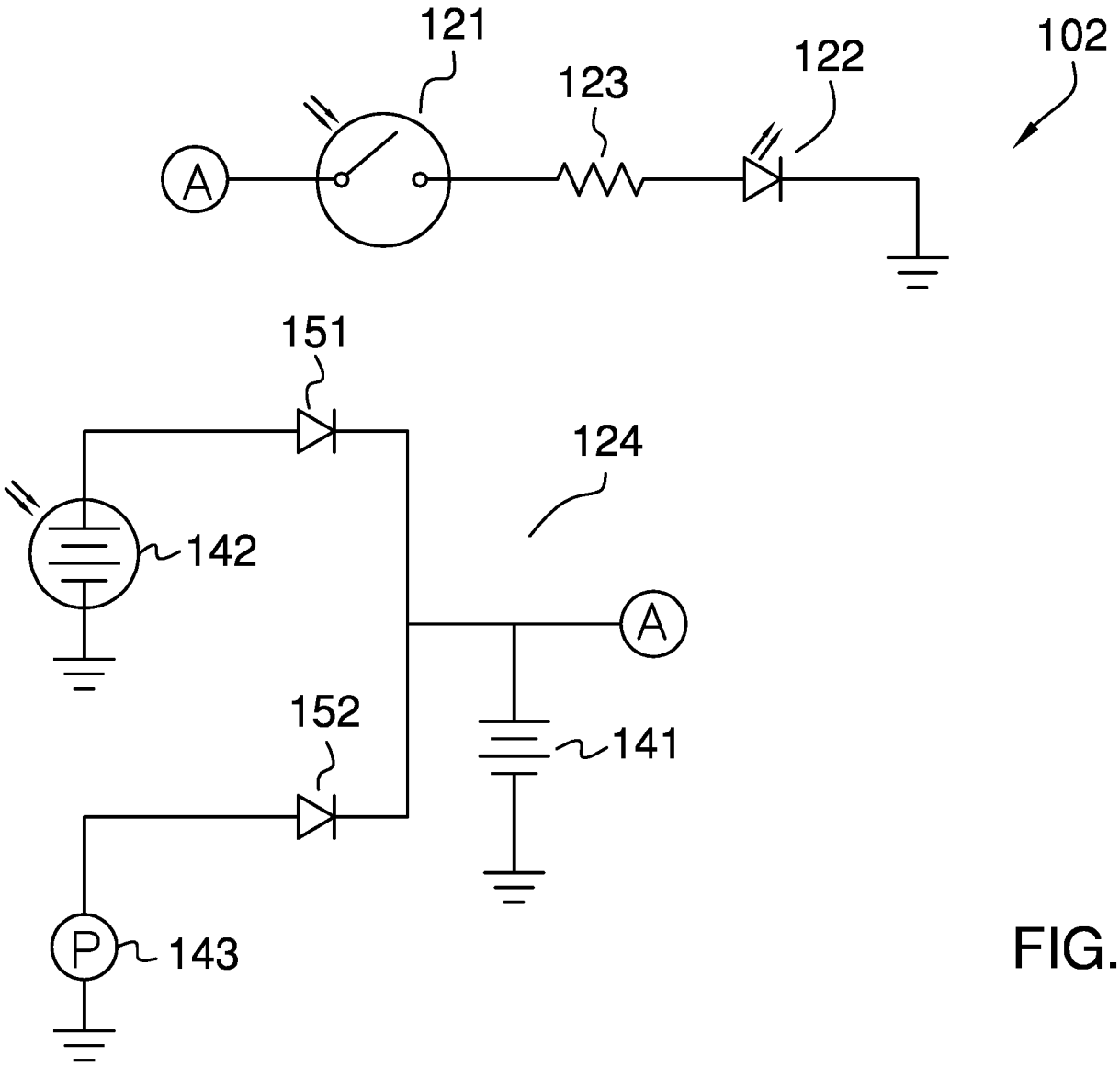
FIG. 8 is a schematic view of an embodiment of the disclosure.

Detailed reference will now be made to one or more potential embodiments of the disclosure, which are illustrated in FIGS. 1 through 8.

The solar-powered light for motorists on roadways 100 (hereinafter invention) is an electrical device. The invention 100 is configured for use on a path of a multipath structure. This disclosure assumes that the path is a road 104. The invention 100 mounts in the road 104. The invention 100 generates electromagnetic radiation that illuminates the road 104 when the road 104 is in a period of darkness. The invention 100 comprises a housing 101 and a lamp circuit 102. The housing 101 contains the lamp circuit 102. The lamp circuit 102 is independently powered. By independently powered is meant that the lamp circuit 102 can operate without an electrical connection to an external power source. The road 104 is defined elsewhere in this disclosure.

The housing 101 is a mechanical structure. The housing 101 is a rigid structure. The housing 101 contains the lamp circuit 102. The housing 101 is formed with all apertures and form factors necessary to allow the housing 101 to accommodate the use and operation of the lamp circuit 102. Methods to form a housing 101 suitable for the purposes described in this disclosure are well-known and documented in the mechanical arts. The housing 101 permanently mounts in the road 104. The housing 101 comprises a pan structure 111 and a semitransparent enclosure 112.

The pan structure 111 is a prism-shaped structure. The pan structure 111 is a hollow structure. The pan structure 111 is a rigid structure. The pan structure 111 has a pan shape. The pan structure 111 forms the containment space that holds the lamp circuit 102. The pan structure 111 further comprises a superior chamber 113 and an inferior chamber 114. The pan structure 111 is bifurcated into the inferior chamber 114 and the superior chamber 113. The pan structure 111 a fluid impermeable barrier separates the inferior chamber 114 from the superior chamber 113. The superior chamber 113 contains the photoelectric structures of the lamp circuit 102. The inferior chamber 114 contains the thermoelectric structure (i.e. the Peltier module 143) of the lamp circuit 102.

The semitransparent enclosure 112 is a prism-shaped structure. The semitransparent enclosure 112 is a rigid structure. The semitransparent enclosure 112 is a semitransparent structure. The semitransparent enclosure 112 is geometrically similar to the open face of the pan shape of the pan structure 111. The semitransparent enclosure 112 encloses the open face of the pan structure 111 to form a water tight seal. The semitransparent enclosure 112 forms the superior surface of the housing 101.

The lamp circuit 102 is an electric circuit. The lamp circuit 102 is a light activated circuit. The lamp circuit 102 monitors the illumination of the road 104. The lamp circuit 102 generates electromagnetic radiation that illuminates the road 104 when the road 104 is in darkness. The lamp circuit 102 is an independently powered electric circuit. By independently powered is meant that the lamp circuit 102 can operate without an electrical connection to an external power source. The lamp circuit 102 comprises a photoswitch 121, a plurality of LEDs 122, a limit resistor 123, and a power circuit 124. The photoswitch 121, the plurality of LEDs 122, the limit resistor 123, and the power circuit 124 are electrically interconnected.

The photoswitch 121 is a light actuated switch. The purpose of the photoswitch 121 is to limit the illumination of the plurality of LEDs 122 to periods of darkness. Specifically, the photoswitch 121 is an electrical device that closes an electric circuit in response to the exposure of the photoswitch 121 to darkness. The photoswitch 121 opens the electric circuit in response to the exposure of the photoswitch 121 to light. The photoswitch 121 controls the flow of electricity from the power circuit 124 into the plurality of LEDs 122 and the limit resistor 123. Specifically, the photoswitch 121 enables the flow of electricity through the plurality of LEDs 122 such that the plurality of LEDs 122 generate electromagnetic radiation in periods of darkness.

Each of the plurality of LEDs 122 is an electric circuit element. Each of the plurality of LEDs 122 generates electromagnetic radiation in response to an electric circuit flowing through the plurality of LEDs 122. The limit resistor 123 electrically connects in series with the plurality of LEDs 122. The limit resistor 123 limits the amount of electric current that flows through the plurality of LEDs 122.

The power circuit 124 is an electrical circuit. The power circuit 124 powers the operation of the lamp circuit 102. The power circuit 124 is an electrochemical device. The power circuit 124 converts chemical potential energy into the electrical energy required to power the lamp circuit 102. The power circuit 124 comprises a battery 141, a photovoltaic cell 142, a Peltier module 143, a first isolation diode 151, and a second isolation diode 152. The battery 141, the photovoltaic cell 142, the Peltier module 143, the first isolation diode 151, and the second isolation diode 152 are electrically interconnected.

The battery 141 is an electrochemical device. The battery 141 converts chemical potential energy into the electrical energy used to power the lamp circuit 102. The battery 141 is a commercially available rechargeable battery 141. The chemical energy stored within the rechargeable battery 141 is renewed and restored through the use of the Peltier module 143 and the photovoltaic cell 142. The Peltier module 143 and the photovoltaic cell 142 are independent electrical circuits that each reverse the polarity of the rechargeable battery 141 and provides the energy necessary to reverse the chemical processes that the rechargeable battery 141 initially used to generate the electrical energy. This reversal of the chemical process creates a chemical potential energy that will later be used by the rechargeable battery 141 to generate electricity. The Peltier module 143 and the photovoltaic cell 142 are simultaneously electrically connected to the battery 141.

The first isolation diode 151 is an electrical device that allows current to flow in only one direction. The first isolation diode 151 installs between the rechargeable battery 141 and the photovoltaic cell 142 such that electricity will not flow from the rechargeable battery 141 into the photovoltaic cell 142. The first isolation diode 151 installs between the Peltier module 143 and the photovoltaic cell 142 such that electricity will not flow from the Peltier module 143 into the photovoltaic cell 142.

The second isolation diode 152 is an electrical device that allows current to flow in only one direction. The second isolation diode 152 installs between the rechargeable battery 141 and the Peltier module 143 such that electricity will not flow from the rechargeable battery 141 into the Peltier module 143. The second isolation diode 152 installs between the photovoltaic cell 142 and the Peltier module 143 such that electricity will not flow from the photovoltaic cell 142 into the Peltier module 143. The photovoltaic cell 142 is a photoelectric device that converts light into electric energy. The Peltier module 143 is a thermoelectric device that converts a temperature differential into electric energy. The photovoltaic cell 142 and the Peltier module 143 are defined elsewhere in this disclosure. The photovoltaic cell 142 mounts near the semitransparent enclosure 112. The photovoltaic cell 142 converts sunlight into electric energy. The Peltier module 143 mounts near the road 104 surface. The Peltier module 143 uses the temperature differential between the temperature of the road 104 and the interior temperature of the housing 101 to generate electric energy.

The supervisory structure 103 is an electric circuit. The supervisory structure 103 monitors the operation of the lamp circuit 102. The supervisory structure 103 determines whether the lamp circuit 102 is operating properly. The supervisory structure 103 transmits a message to an appropriate authority 132 if the lamp circuit 102 is not operating properly. In a second potential embodiment of the disclosure, the invention 100 further comprises a supervisory structure 103. The supervisory structure 103 comprises a logic module 131 and an appropriate authority 132. The logic module 131 is a programmable electronic device that is used to manage, regulate, and operate the lamp circuit 102. The logic module 131 monitors the operation of the lamp circuit 102. When the logic module 131 detects a problem with the lamp circuit 102, the logic module 131 transmits an SMS message to an appropriate authority 132 indicating there is a problem. The appropriate authority 132 is defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Appropriate Authority: As used in this disclosure, an appropriate authority is a previously determined person or organization that is designated to send and receive alarm or other notification messages regarding a monitored system or activity.

Battery: As used in this disclosure, a battery is a chemical device consisting of one or more cells, in which chemical energy is converted into electricity and used as a source of power. Batteries are commonly defined with a positive terminal and a negative terminal.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Communication Link: As used in this disclosure, a communication link refers to the structured exchange of data between two objects.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Inferior: As used in this disclosure, the term inferior refers to a directional reference that is parallel to and in the same direction as the force of gravity when an object is positioned or used normally.

Lamp: As used in this disclosure, a lamp is an electrical circuit that generates (typically visible spectrum) electromagnetic radiation.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Multipath Structure: As used in this disclosure, a multipath structure refers to a plurality of path structures that offer a plurality of different routes sharing the same starting point and the same destination point. A road network is considered a multipath structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Path: As used in this structure, a path is a marked or identified route along which an individual or object can travel. A path is often formed as a track, a road or a trail.

Perimeter: As used in this disclosure, a perimeter is one or more curved or straight lines that bounds an enclosed area on a plane or surface. The perimeter of a circle is commonly referred to as a circumference.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photoswitch: As used in this disclosure, a photoswitch is a switch that is actuated with light. The operation of a photoswitch is often based on the use of a photoelectric device.

Photovoltaic Cell: As used in this disclosure, a photovoltaic cell is a photoelectric device that directly converts light energy into electrical energy.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Rigid Structure: As used in this disclosure, a rigid structure is a solid structure formed from an inelastic material that resists changes in shape. A rigid structure will permanently deform as it fails under a force.

Semitransparent: As used in this disclosure, semitransparent refers to an object that is partially transparent. By partially transparent is meant: a) that only a proportion of the light that strikes a semitransparent structure will pass through the semitransparent structure; and, b) that the light is scattered as it passes through the semitransparent structure such that objects cannot be clearly seen through the semitransparent structure.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Transparent: As used in this disclosure, transparent refers to a material that allows light to pass through the material without significant scattering such that an object can be clearly seen through the material.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wireless: As used in this disclosure, wireless is an adjective that is used to describe a communication link between two devices that does not require the use of physical cabling.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A lighting circuit comprising
a housing and a lamp circuit;
wherein the housing contains the lamp circuit;
wherein the lamp circuit comprises a photoswitch, a plurality of LEDs, a limit resistor, and a power circuit;
wherein the photoswitch, the plurality of LEDs, the limit resistor, and the power circuit are electrically interconnected;
wherein the power circuit comprises a battery, a photovoltaic cell, a Peltier module, a first isolation diode, and a second isolation diode;
wherein the battery, the photovoltaic cell, the Peltier module, the first isolation diode, and the second isolation diode are electrically interconnected.

2. The lighting circuit according to claim 1
wherein the lighting circuit is for use on a road;
wherein the lighting circuit mounts in the road;
wherein the lighting circuit generates electromagnetic radiation that illuminates the road when the road is in a period of darkness.

3. The lighting circuit according to claim 2
wherein the lamp circuit is independently powered;
wherein by independently powered is meant that the lamp circuit can operate without an electrical connection to an external power source.

4. The lighting circuit according to claim 3
wherein the housing is a mechanical structure;
wherein the housing is a rigid structure;
wherein the housing permanently mounts in the road.

5. The lighting circuit according to claim 4
wherein the lamp circuit is an electric circuit;
wherein the lamp circuit is a light activated circuit;
wherein the lamp circuit monitors an illumination of the road.

6. The lighting circuit according to claim 5
wherein the housing comprises a pan structure and a semitransparent enclosure;
wherein the semitransparent enclosure is geometrically similar to the pan structure;
wherein the semitransparent enclosure encloses the pan structure to form a water tight seal.

7. The lighting circuit according to claim 6
wherein the power circuit is an electrical circuit;
wherein the power circuit powers an operation of the lamp circuit;
wherein the power circuit is an electrochemical device;
wherein the power circuit converts chemical potential energy into electrical energy required to power the lamp circuit.

8. The lighting circuit according to claim 7
wherein the pan structure is a prism-shaped structure;
wherein the pan structure is a hollow structure;
wherein the pan structure is a rigid structure;
wherein the pan structure has a pan shape;
wherein the pan structure forms a containment space that holds the lamp circuit.

9. The lighting circuit according to claim 8
wherein the semitransparent enclosure is a prism-shaped structure;
wherein the semitransparent enclosure is a rigid structure;
wherein the semitransparent enclosure is a semitransparent structure;
wherein the semitransparent enclosure forms a superior surface of the housing.

10. The lighting circuit according to claim 9 wherein the pan structure further comprises a superior chamber and an inferior chamber;

wherein the pan structure is bifurcated into the inferior chamber and the superior chamber;

wherein the superior chamber contains the photovoltaic cell of the lamp circuit;

wherein the inferior chamber contains the Peltier module.

11. The lighting circuit according to claim 10 wherein the photoswitch is a light actuated switch;

wherein the photoswitch is an electrical device that closes an electric circuit in response to the exposure of the photoswitch to darkness;

wherein the photoswitch opens the electric circuit in response to the exposure of the photoswitch to light;

wherein the photoswitch controls the flow of electricity from the power circuit into the plurality of LEDs and the limit resistor;

wherein the photoswitch enables the flow of electricity through the plurality of LEDs such that the plurality of LEDs generate electromagnetic radiation in periods of darkness.

12. The lighting circuit according to claim 11 wherein each of the plurality of LEDs is an electric circuit element;

wherein each of the plurality of LEDs generates electromagnetic radiation in response to an electric circuit flowing through the plurality of LEDs;

wherein the limit resistor electrically connects in series with the plurality of LEDs;

wherein the limit resistor limits the amount of electric current that flows through the plurality of LEDs.

13. The lighting circuit according to claim 12 wherein the battery is a rechargeable battery;

wherein the Peltier module and the photovoltaic cell are independent electrical circuits that each reverse a polarity of the rechargeable battery and provides energy necessary to reverse the chemical processes that the rechargeable battery initially used to generate the electrical energy;

wherein the Peltier module and the photovoltaic cell are simultaneously electrically connected to the battery.

14. The lighting circuit according to claim 13 wherein the first isolation diode is an electrical device that allows current to flow in only one direction;

wherein the first isolation diode installs between the rechargeable battery and the photovoltaic cell such that electricity will not flow from the rechargeable battery into the photovoltaic cell;

wherein the first isolation diode installs between the Peltier module and the photovoltaic cell such that electricity will not flow from the Peltier module into the photovoltaic cell;

wherein the second isolation diode is an electrical device that allows current to flow in only one direction;

wherein the second isolation diode installs between the rechargeable battery and the Peltier module such that electricity will not flow from the rechargeable battery into the Peltier module;

wherein the second isolation diode installs between the photovoltaic cell and the Peltier module such that electricity will not flow from the photovoltaic cell into the Peltier module.

* * * * *